United States Patent [19]

Furukawa et al.

[11] Patent Number: 4,795,681

[45] Date of Patent: Jan. 3, 1989

[54] STEEL SHEETS FOR PAINTING AND A METHOD OF PRODUCING THE SAME

[75] Inventors: Kusuo Furukawa, Tokyo; Teruo Fujiwara, Kawachi, both of Japan

[73] Assignees: Kawasaki Steel Corporation, Kobe; Nissan Motor Co., Ltd., Yokohama, both of Japan

[21] Appl. No.: 29,083

[22] Filed: Mar. 23, 1987

[30] Foreign Application Priority Data

Mar. 31, 1986 [JP] Japan ..... 61-73850

[51] Int. Cl.[4] ..... B21D 53/00

[52] U.S. Cl. ..... 428/600; 428/687; 428/925; 72/199

[58] Field of Search ..... 428/679, 684, 687, 600, 428/607, 923, 925; 29/121.1, 121.8; 72/199

[56] References Cited

U.S. PATENT DOCUMENTS

| | | | |
|---|---|---|---|
| 2,991,544 | 7/1961 | Gotsch et al. | 428/687 |
| 3,619,881 | 11/1971 | Bills et al. | 428/600 |
| 3,623,850 | 11/1971 | Horvath | 428/687 |
| 4,071,657 | 1/1978 | Rault | 428/648 |
| 4,111,032 | 9/1978 | Rault | 72/366 |
| 4,200,382 | 4/1980 | Friedman | 29/121.1 |
| 4,679,288 | 7/1987 | Monfort et al. | 29/121.8 |

FOREIGN PATENT DOCUMENTS

| | | | |
|---|---|---|---|
| 157754 | 10/1985 | European Pat. Off. | 29/121.8 |
| 0234698 | 1/1987 | European Pat. Off. . | |
| 8330 | 4/1979 | Japan | 428/687 |
| 54-61043 | 5/1979 | Japan . | |
| 55-94790 | 7/1980 | Japan . | |
| 58-34402 | 2/1983 | Japan . | |
| 58-154483 | 9/1983 | Japan . | |
| 1045641 | 10/1966 | United Kingdom . | |
| 2040824A | 9/1980 | United Kingdom | 219/121 LM |
| 2069906A | 9/1981 | United Kingdom | 219/121 LM |

OTHER PUBLICATIONS

Cahiers d'Informations Techniques de la Revue de Metallurgie, vol. 80, No. 5, May 1983, pp. 393–401, Paris, Fr., J. Crahay, et al.; "Gravure de la rugosite des cylindres de laminoir par impulsions laser".

*Primary Examiner*—John J. Zimmerman

*Attorney, Agent, or Firm*—Balogh, Osann, Kramer, Dvorak, Genova & Traub

[57] ABSTRACT

A painting steel sheet having an improved distinctness of image after painting has a waviness curve of section profile satisfying given relationships, and is produced by temper rolling a steel sheet with work rolls dulled to particular dimensions through laser.

5 Claims, 15 Drawing Sheets

STEEL SHEETS FOR PAINTING AND A METHOD OF PRODUCING THE SAME

BACKGROUND OF THE INVENTION

1. Field of the Invention

This invention relates to steel sheets for painting, which are used by the forming such as press forming or the like as an outer panel for automobile or a decorative outer plate for electric appliances, and a method of producing the same. More particularly, it relates to steel sheets for painting having an improved distinctness of image after painting and a method of producing the same.

Here, the term "steel sheet" used herein means to include cold rolled steel sheets, surface-treated steel sheets, hot rolled steel sheets and so on, which are capable of being subjected to a painting treatment.

2. Related Art Statement

In general, the formable thin steel sheets such as cold rolled thin steel sheets are produced by subjecting the steel sheet after the cold rolling to degreasing, annealing and temper rolling in this order. In this case, the temper rolling is to improve the galling resistance in the press forming by conducting a light rolling through work rolls having a dulled surface to give a proper surface roughness to the steel sheet surface.

As a process for dulling the surface of the work roll to be used in the temper rolling, there have hitherto been practised a shot blast process and a discharge working process.

When the work roll is subjected to a dulling according to these processes, an irregular section profile is formed on the surface of the work roll, and consequently the steel sheet after the temper rolling using such a work roll indicates a rough surface comprising a plurality of irregular mountain and valley portions. If such a surface roughened steel sheet is subjected to a press forming, a lubricating oil is reserved in the valley portions to reduce friction force between press mold and steel sheet and hence make the press operation easy, while metallic debris exfoliated by the friction force to the mold are trapped in the valley portions to prevent the galling.

Recently, the finish feeling after painting on vehicle body in passenger cars and trucks is a very important quality control item because the height in synthetic quality of automobile can directly be appealed to the eye of the user as a good finish quality.

Now, there are several evaluation items on the painted surface. Among them, it is particularly important that a glossiness lessening irregular reflection on the painting surface and an image clarity defining few image distortion are excellent. In general, the combination of the glossiness and the image clarity is called as a distinctness of image.

The distinctness of image on the painted surface is dependent upon the kind of paint and the painting process, and is also strongly influenced by the rough surface of the steel sheet as a substrate. That is, when the unevenness of the steel sheet surface is much, the painted surface becomes much uneven, and consequently the irregular reflection of light is caused to damage the glossiness and also the image distortion is produced to deteriorate the image clarity, so that the distinctness of image is degraded.

Generally, the section profile of the steel sheet surface is divided into a roughness curve and a waviness curve. Heretofore, the distinctness of image in the painted surface has been determined by a centerline average roughness (Ra) in the roughness curve. In this case, it is known that as the value of Ra becomes larger, the amplitude between mountain portion and valley portion is large and hence the unevenness of the painted surface becomes large and consequently the distinctness of image is degraded. On the other hand, the waviness curve has not been noticed as a method for evaluating the distinctness of image at all.

As the method for evaluating the distinctness of image after painting, there have been developed various systems. Among them, a value measured by means of a Dorigon meter made by Hunter Associates Laboratory or a so-called DOI value is most usually used. The DOI value is expressed by the following equation:

$$DOI = 100 \times (Rs - R_{0.3})/Rs,$$

wherein Rs is an intensity of a specular reflected light when a light entered at an incident angle of 30° is reflected at a specular reflective angle of 30° with respect to a sample, and $R_{0.3}$ is an intensity of a scattered light at a reflective angle of 30°±0.3°.

Further, an image clarity (C, %) measured by means of an image measuring meter (HA-ICM model) made by Suga Shikenki K.K. is also usually used. In this case, a quantity of light reflected on a sample is measured through a moving optical comb, from which is calculated an image clarity or image definition (C, %) indicating a combination of image clearness, image distortion and haze in the visual feeling process.

The optical comb is made so as to match with a chart scale. In the measurement, a parallel light passing from a light source through a slit having a width of 0.03±0.005 mm is reflected on a sample. The reflected light is focused through a lens and received on a light receiving means through an optical comb moving in left and right directions. The change of light quantity detected by the light receiving means is converted into a wave form through an instrument device connected to the light receiving means, from which the image definition (C, %) can be calculated.

Here, the image definition (C, %) is defined by the following equation:

$$C(\%) = \frac{M - m}{M + m} \times 100,$$

wherein M is a maximum value of light quantity transmitted from a transparent portion of the optical comb and m is a minimum value of light quantity transmitted from an opaque portion thereof. The larger the C value, the higher the image clarity, while the smaller the C value, the larger the amount of haze or image distortion.

When the steel sheet is subjected to a temper rolling with work rolls dulled through the conventional shot blast process or discharge working process, it exhibits a rough surface comprised of irregular mountain and valley portions as previously mentioned. If the painting is applied to the steel sheet having such irregular mountain and valley portions, since the coating is formed along the slopes of the mountain and valley portions, the distinctness of image is degraded. That is, such a problem can not be avoided in the steel sheets for painting temper rolled with work rolls through the shot blast process (hereinafter referred to as SB sheet) and discharge working process (hereinafter referred to as ED sheet), so that it is very difficult to provide a sufficiently improved distinctness of image on the painted surface. That is, the dull pattern in the SB and ED sheets is random and the reproducibility thereof is considerably poor, so that the scattering of the distinctness of image after painting becomes large.

On the other hand, when the center-line average roughness Ra in the SB and ED sheets is made too small for improving the distinctness of image, the amount of lubricating oil held in the sheet is reduced in the press forming to cause the galling phenomenon or the like, resulting in the reduction of operation efficiency, deterioration of quality, decrease of yield and the like.

Therefore, the SB and ED sheets can not satisfy the simultaneous establishment of press formability and distinctness of image after painting, so that they can not be adopted as a means for improving the distinctness of image after painting.

SUMMARY OF THE INVENTION

Under the above circumstances, it is an object of the invention to provide steel sheets having an improved distinctness of image after painting by improving a section profile of a steel sheet surface on its waviness to lessen the unevenness of the painted surface after painting so as to obtain a high specular light reflectivity and a small image distortion, and a method of efficiently producing steel sheets having such an improved section profile of steel sheet surface. In other words, the invention is to provide steel sheets having a distinctness of image considerably excellent than that of the conventional one without changing the usually used paint and painting process, and a method of producing the same.

According to a first aspect of the invention, there is the provision of a steel sheet for painting, characterized in that the surface of the steel sheet has a microscopic form comprised of mountain portions, groove-like valley portions formed so as to surround a whole or a part of the mountain portion, and middle flat portions formed between the mountain portions outside of the valley portion so as to be higher than the bottom of the valley portion and lower than or equal to the top surface of the mountain portion, and satisfies the following relations:

$$(d+D)/2 \leqq 400\ \mu m$$

$$Sm \leqq 800\ \mu m$$

wherein d is a mean diameter in an inner peripheral edge of the valley portion, D is a mean diameter in an outer peripheral edge of the valley portion and Sm is a mean center distance between the adjoining mountain portions.

According to a second aspect of the invention, there is the provision of a method of producing steel sheets for painting, which comprises subjecting a surface of a work roll for temper rolling to a dulling of surface pattern comprised of a combination of fine crater-like concave portions and ring-like convex portions upheaving at the outer peripheral edge of the concave portion and satisfying the following relations:

$$(D'+d')/2 \leqq 400\ \mu m$$

$$S'm \leqq 800\ \mu m$$

wherein d' is a diameter in an inner peripheral edge of the ring-like convex portion, D' is a diameter in an outer peripheral edge of the ring-like convex portion and S'm is a mean center distance between the adjoining concave portions, through a high density energy source, and then temper rolling a steel sheet with a pair of work rolls, at least one of which being the above dulled work roll to transfer the surface pattern of the dulled work roll to the surface of the steel sheet.

BRIEF DESCRIPTION OF THE DRAWINGS

The invention will be described with reference to the accompanying drawings, wherein.

DESCRIPTION OF THE PREFERRED EMBODIMENTS

The inventors have made the following experiments in order to achieve the aforementioned object.

At first, there were provided SB sheets and ED sheets having different values of center-line average roughness (Ra). Then, each of these sheets was subjected to a phosphating treatment and further to a painting for three-layer coating (total coating thickness: 80 μm). In this case, the center-line average roughness (Ra) in the roughness curve and the filtered center-line waviness (Wca) in the waviness curve were measured before and after the painting. An example of the measured results is shown in FIG. 1.

Figure 1:
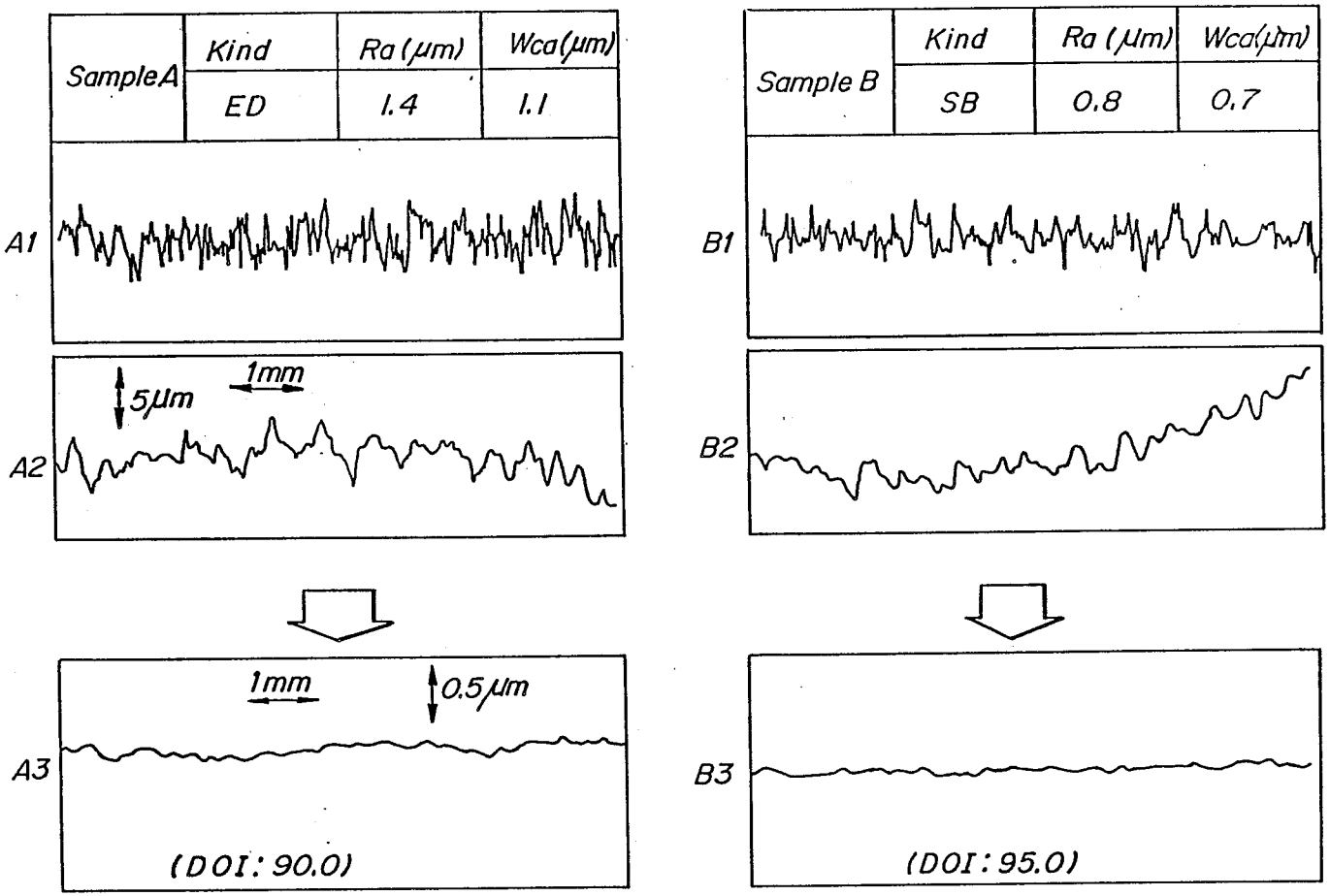
FIG. 1 PRIOR ART
FIG. 1 is a schematic view illustrating a comparison of surface properties in steel sheets temper rolled with work rolls dulled through the conventional shot blast process and discharge working process.

In FIG. 1, the charts $A_1$, $B_1$ are roughness curves, respectively, from which the center-line average roughness Ra is determined according to the following equation (1):

$$Ra = \frac{1}{L} \int_0^L |Y| dL \quad (1)$$

As a result, Ra was 1.4 μm in the sample A and 0.8 μm in the Sample B.

The charts $A_2$, $B_2$ are waviness curves obtained by dealing the waves of the charts $A_1$, $B_1$ with the method of JIS B0610 (at a cut-off setting value of 0.4 mm), respectively. As a result, Wca was 1.1 μm in the sample A and 0.7 μm in the sample B.

The charts $A_3$, $B_3$ are roughness curves on the painted surfaces after the painting, respectively, whose wave pitches are approximately coincident with those of the charts $A_2$, $B_2$. The sample A after the painting had Ra of 0.04 μm and DOI of 90.0 as a distinctness of image, and the sample B after the painting had Ra of 0.02 μm and DOI of 95.0.

From the above, it can be seen that the waviness component of the steel sheet (several hundreds μm) appears in the painted surface as it is and strongly affects the distinctness of image.

In order to further examine the relation between the waviness and the distinctness of image after painting, various SB sheets and steel sheets temper rolled with laser dulled work rolls (hereinafter referred to as LD sheet) as mentioned later were provided, and then the wavelength of waviness component before and after the painting was analyzed with respect to these sheets by power spectrography as follows.

The profiles of the steel sheet surface and the painted surface were measured by means of a three-dimensional roughness measuring machine, which were input into a computer through an interface. In this case, 10 profiles were measured per one sheet sample, and the measuring point per one profile was 1,024. In the computer, A/D conversion values of the profile were passed through a digital filter by a moving average process for improving S/N ratio after trends were removed by a minimum mean square process, and then a pulse height distribution was calculated. Thereafter, the power spectrum was determined by FFT (fast fourier transformation) using a Hanning window function as a pretreatment for FFT.

Figure 2:
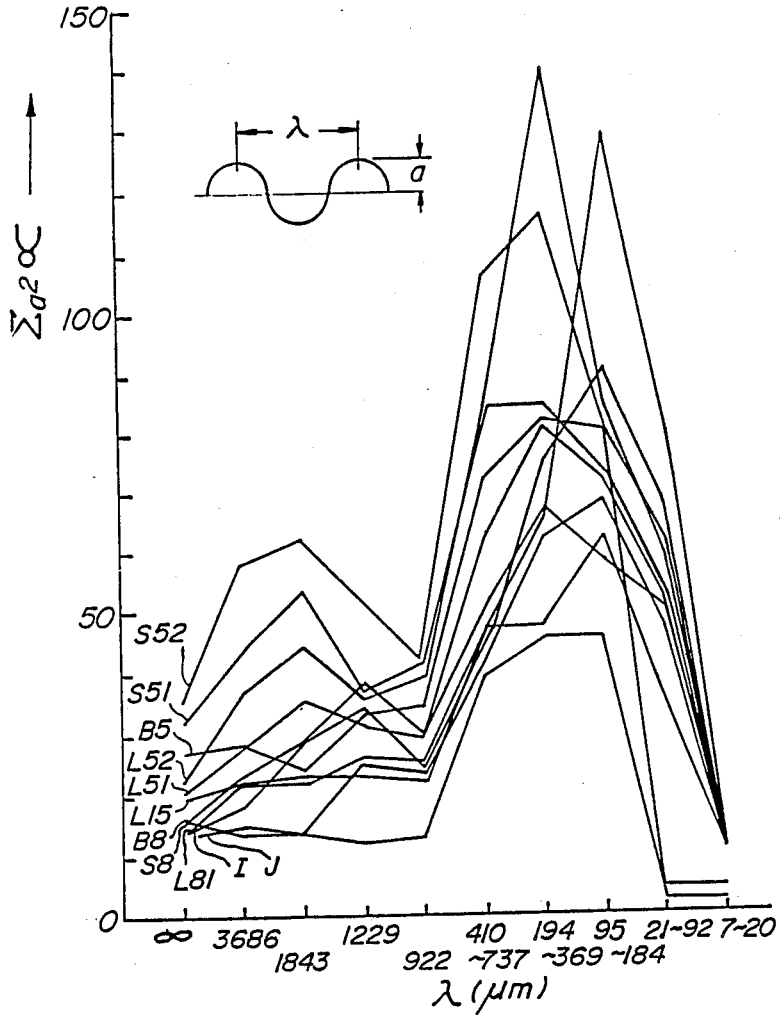
FIG. 2 is a graph showing a relation between wavelength and intensity in waviness curve at surfaces of various dulled steel sheets before painting.
Figure 3:
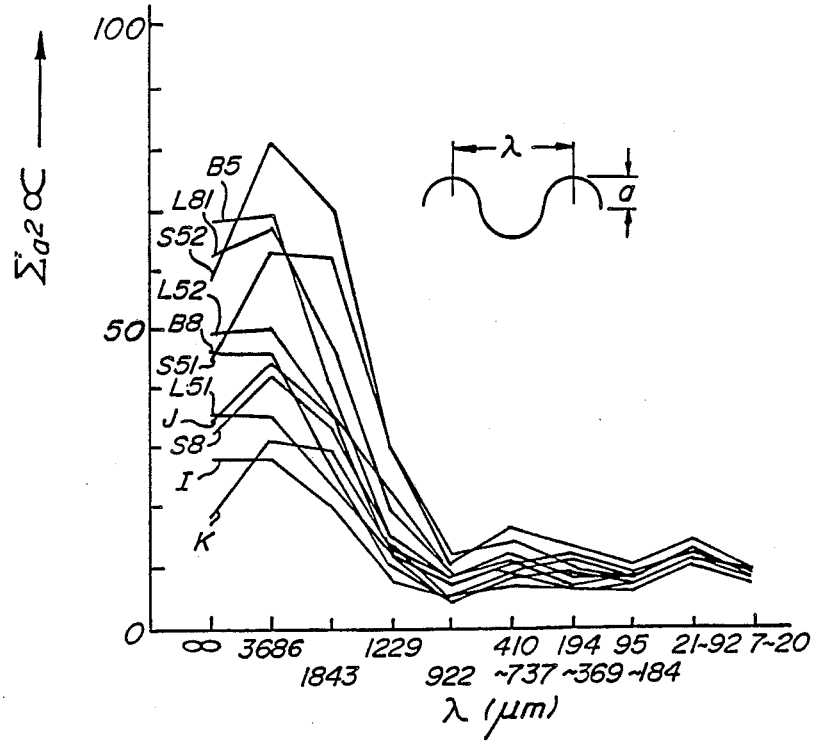
FIG. 3 is a graph showing a relation between wavelength and intensity in waviness curve at painted surfaces after painting.

The results by the power spectrography are shown in FIGS. 2 and 3 as a relation between the wavelength (λ) of waviness component in the steel sheet surface or the painted surface and the intensity thereof.

As seen from FIG. 2, the steel sheet surface before the painting has a power spectrum having two peaks as brrdered on the wavelength of about 900 μm. On the other hand, in the painted surface as shown in FIG. 3, the waviness components of less than 410 μm are considerably reduced, but the waviness components of more than 922 μm are still remaining. That is, the waviness components with a short wavelength of less than 410 μm are concealed by the painting.

Figure 4:
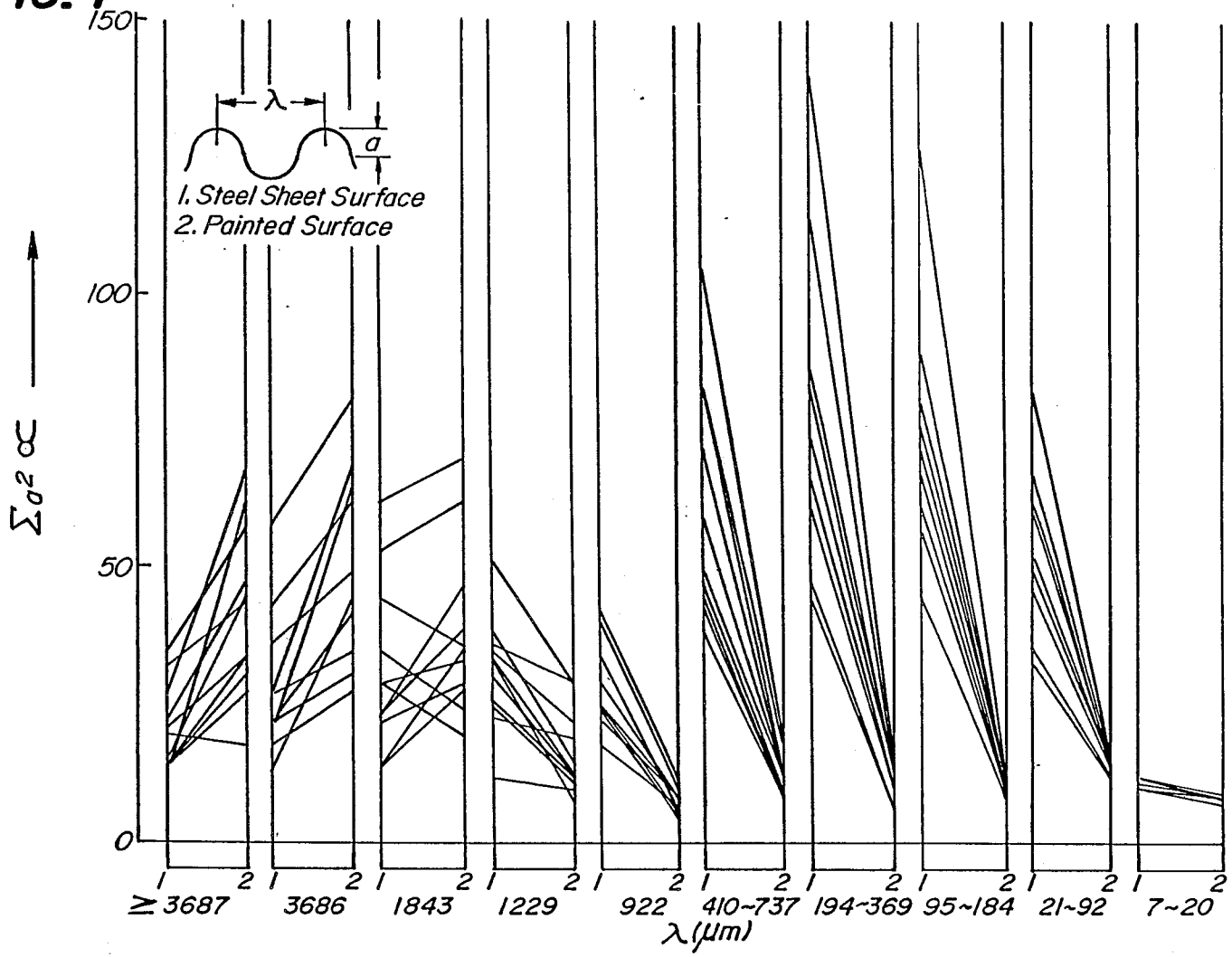
FIG. 4 is a schematic view showing a change of intensity every given wave range in waviness curve between the steel sheet surface before painting and the painted surface.

The change of the intensity in FIGS. 2 and 3 every the given wave range before and after the painting is shown in FIG. 4. As shown from FIG. 4, the change of the intensity before and after the painting approaches to zero as the wavelength of the waviness component becomes shorter. In this connection, the damping factor of maximum intensity before and after the painting is shown in the following Table 1.

TABLE 1

| Wavelength | Damping factor by painting = Maximum intensity after painting / Maximum intensity before painting |
|---|---|
| 3,687 μm ≦ | 194% |
| 3,686 | 140% |
| 1,483 | 112% |
| 1,229 | 59% |
| 922 | 26% |
| 410–737 | 15% |
| 194–369 | 9% |
| 95–184 | 8% |
| 21–92 | 17% |
| 7–20 | 71% |

As seen from Table 1, the intensity is considerably damped on the border of 922 μm after the painting. However, the damping at 410–737 μm is not yet sufficient, but the sufficient damping is obtained at a wavelength of less than 410 μm.

Figure 5A:
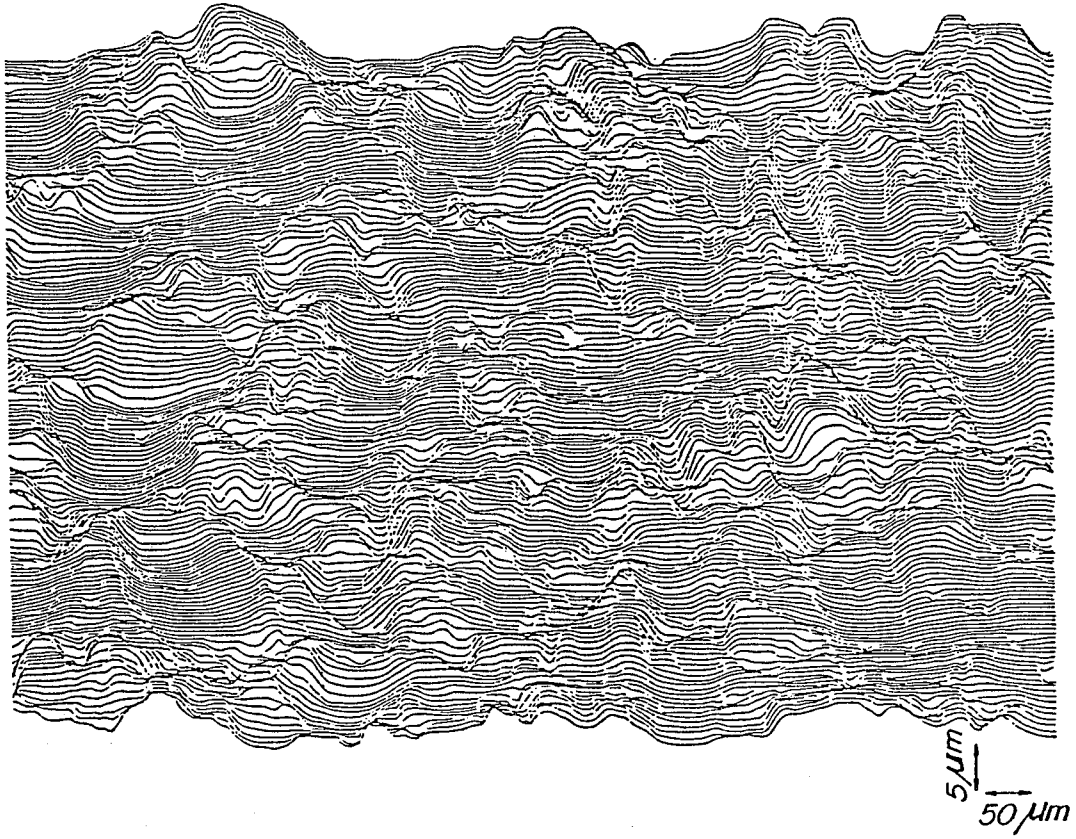
FIG. 5a PRIOR ART
FIGS. 5*a* and 5*b* are three-dimensional roughness curve and waviness curve of the steel sheet dulled by the conventional shot blast process, respectively.
Figure 5B:
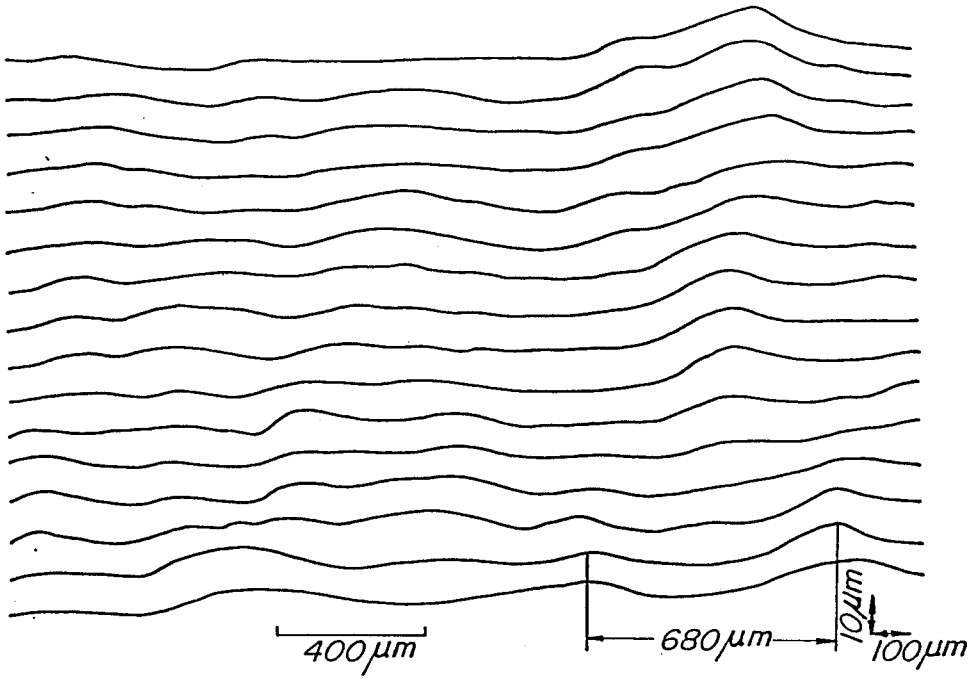
FIG. 5b PRIOR ART

FIG. 5*a* shows a three-dimensional roughness curve of the SB sheet, and FIG. 5*b* shows a waviness curve obtained by dealing the curve of FIG. 5*a* with the method of JIS B0610 (cut-off setting value: 0.4 mm) every an interval of 10 μm, from which it is understood that many waviness components with a wavelength of more than 400 μm are clearly contained in the waviness curve of the SB sheet.

Figure 6A:
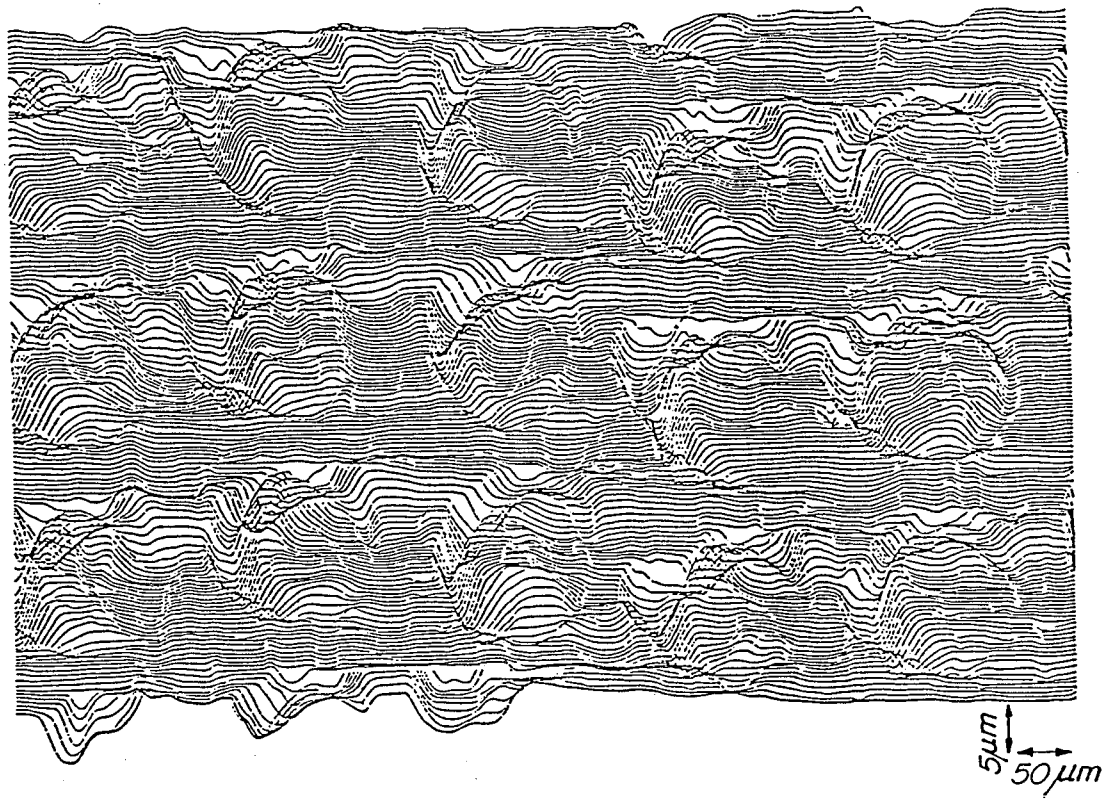
FIGS. 6*a* and 6*b* are three-dimensional roughness curve and waviness curve of the steel sheet dulled through laser poocess according to the invention, respectively.
Figure 6B:
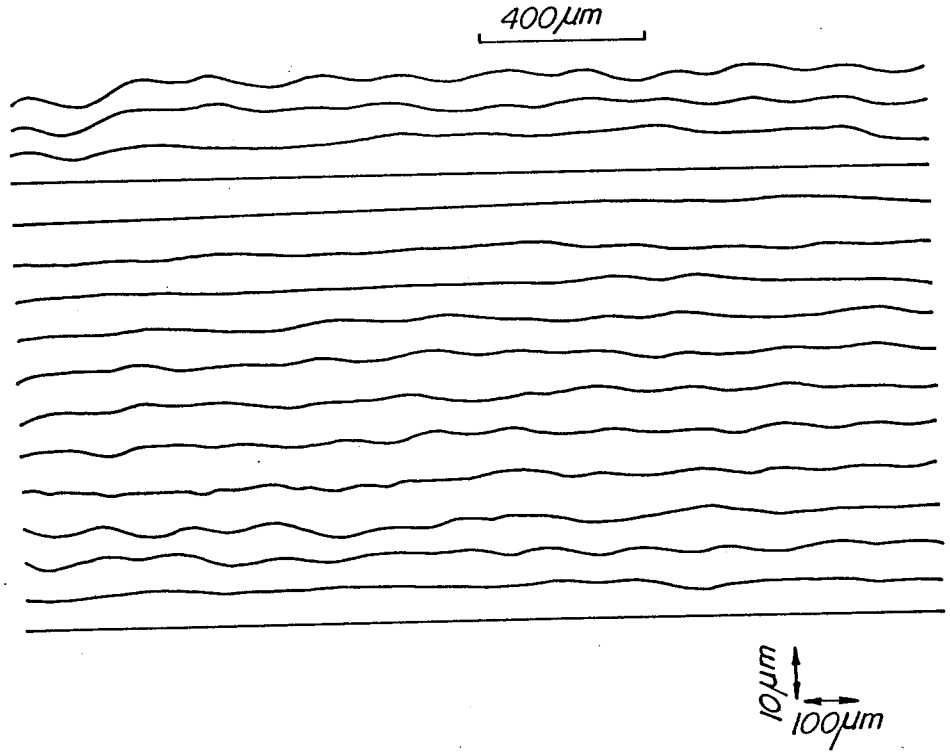

On the other hand, FIG. 6*a* shows a three-dimensional roughness curve of the LD sheet, and FIG. 6*b* shows a waviness curve obtained from FIG. 6*a* in the same manner as described above, from which it is understood that the waviness component with a wavelength of more than 400 μm is not contained in the waviness curve of FIG. 6*b*.

Therefore, if the waviness component with a wavelength of more than 400 μm is made small on the steel sheet surface, the waviness of more than 400 μm on the painted surface becomes sufficiently small, while the waviness of not more than 400 μm is sufficiently concealed by the painting. In this way, the waviness of the painted surface can be lessened over the whole wave range.

From the above, the influence of the waviness component of the steel sheet surface upon the distinctness of image after painting can be considered as follows:

(1) At first, a correlation coefficient γ of regression analysis between intensity of waviness component (quantity proportional to square of integration value of wave amplitude over wave range of the waviness component) and evaluation index of the distinctness of image on the painted surface (value of image definition C (%) by HA-ICM model measuring machine and value of visual evaluation) is measured every a given wavelength (wave range) of the waviness component on the steel sheet surface before the painting and can be said to speak for the reliability of evaluation per the given wave range when the distinctness of image is evaluated by the HA-ICM measuring machine or visual test. If γ≧0.7, it can be judged that the intensity at the respective wave range has a strong influence upon the distinctness of image after painting.

Figure 7:
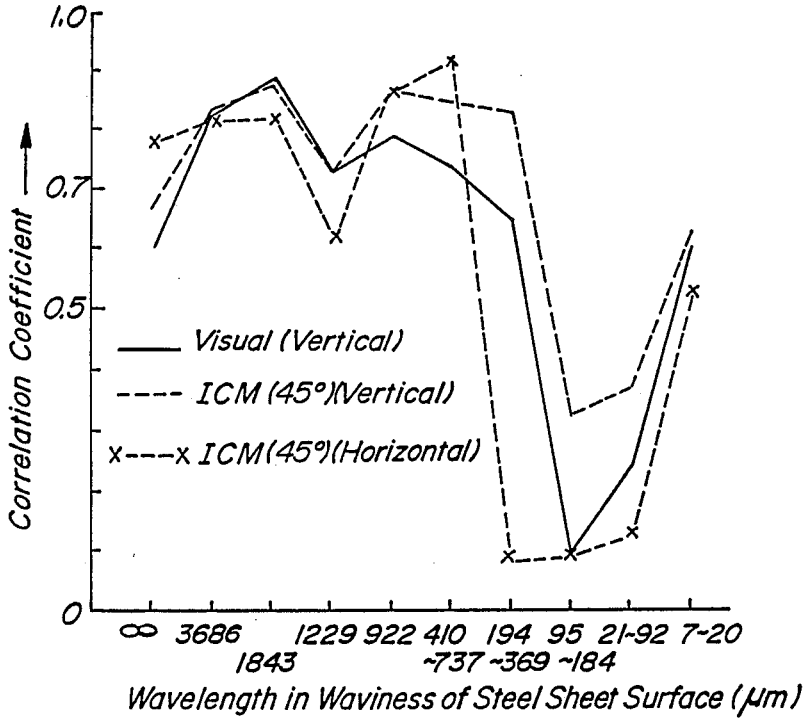
FIG. 7 is a graph showing a relation between wavelength in waviness curve of steel sheet surface and correlation coefficient to appearance of painted surface.

(2) The relttion between the correlation coefficient γ and the wavelength in the waviness of steel sheet surface is shown in FIG. 7. As seen from FIG. 7, the correlation coefficient is not less than 0.7 at a wavelength≧409 μm in the visual evaluation, in which an average of values evaluated by 10 panelists is represented by five point evaluation, and the HA-ICM model measuring machine, which shows that the waviness component having a wavelength of more than 400 μm badly affects the distinctness of image after painting, while the waviness component having a wavelength of not more than 400 μm does not affect the distinctness of image. In other words, the waviness component with the wavelength of not more than 400 μm is fully concealed by the painting as previously mentioned, but only the waviness component with the wavelength of more than 400 μm remains in the painted surface after the painting to deteriorate the smoothness of the painted surface and hence the distinctness of image after painting.

From the above, it is apparent that it is effective to reduce the amplitude of waviness components having a wavelength of more than 400 μm on the steel sheet surface as far as possible in order to improve the distinctness of image after painting.

Figure 8:
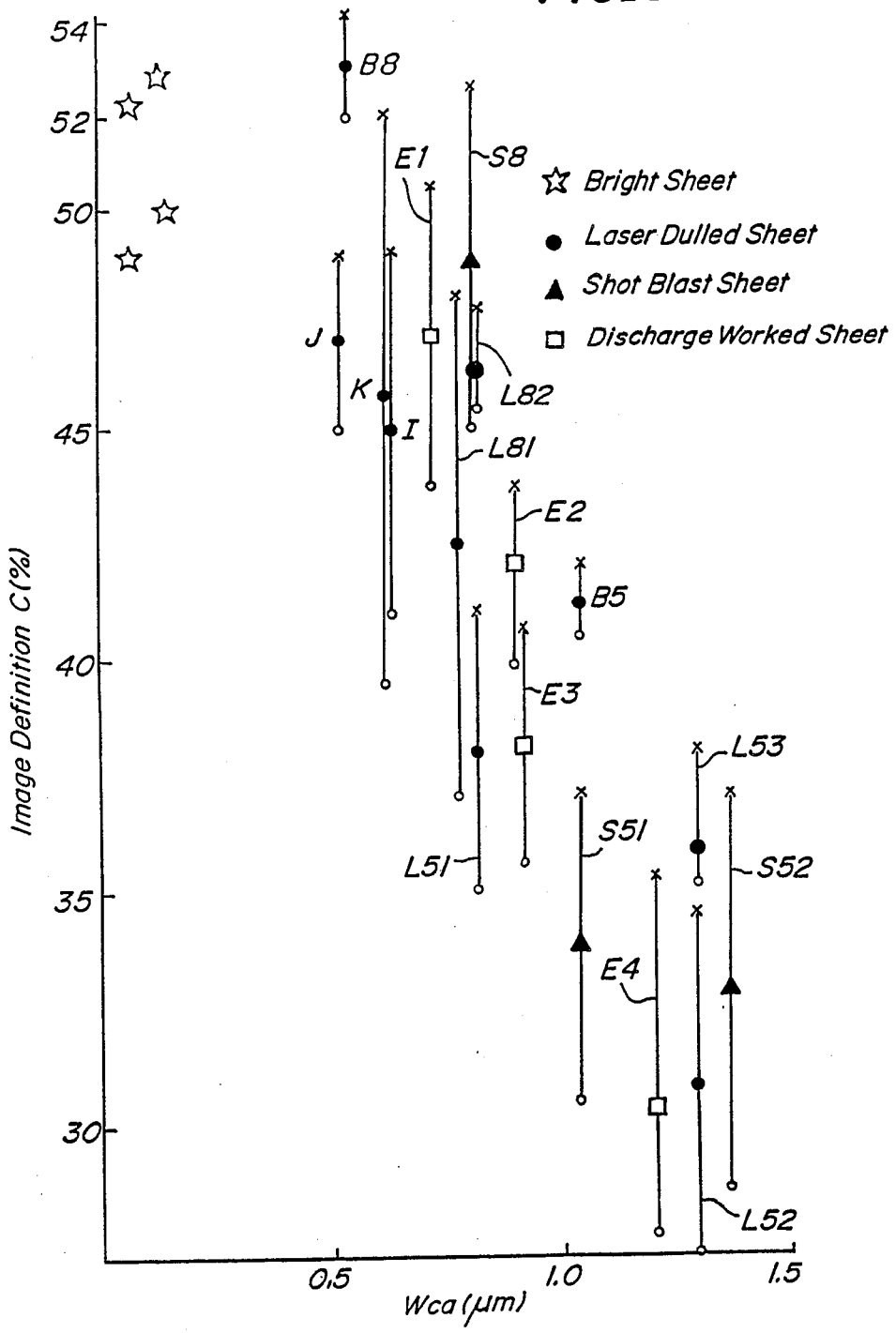
FIG. 8 is a graph showing a relation between filtered center-line waviness (Wca) and image definition (C, %)

In FIG. 8 is shown a relation between the filtered center-line waviness (Wca) in the waviness of steel sheet surface before painting and the image definition (C, %) as a distinctness of image after painting. The term "Wca" means the intensity of waviness including wavelength of more than 400 μm. In the data of each sheet, mark × is a maximum value of C (%) when the sheet is subjected to a painting at horizontal state and mark O is a minimum value of C (%) when the sheet is subjected to a painting at vertical state. In general, the distinctness of image is excellent in the painting at horizontal state than in the painting at vertical state.

As a sample to be used in the test of FIG. 8, there were provided SB sheets, ED sheets, LD sheets and bright steel sheets (hereinafter referred to as B sheet) temper rolled with polished work rolls or so-called bright rolls as described in the following example. As shown in FIG. 8, the LD sheets as well as SB and ED sheets improve the distinctness of image as Wca becomes smaller, and particularly their distinctnesses at Wca≦0.7 μm approach to that of the B sheet.

In general, the bright steel sheets are fairly smooth and very small in the waviness as compared with the dulled steel sheets, so that they are ideal in view of the smoothness after the painting except that the bonding force between steel sheet and paint layer is poor. Therefore, the limit capable of improving the distinctness of image in the steel sheet by dulling the surface of the steel sheet is the level of the distinctness of image in the bright steel sheet.

That is, if the waviness component of the steel sheet having a wavelength of more than 400 μm in the waviness curve at the section profile of steel sheet surface could be reduced as far as possible, or further the filtered center-line waviness (Wca) could be rendered into Wca≦0.7 μm, the highest distinctness of image in the dulled steel sheet can be obtained without changing the kind of paint and the painting process.

Figure 9:
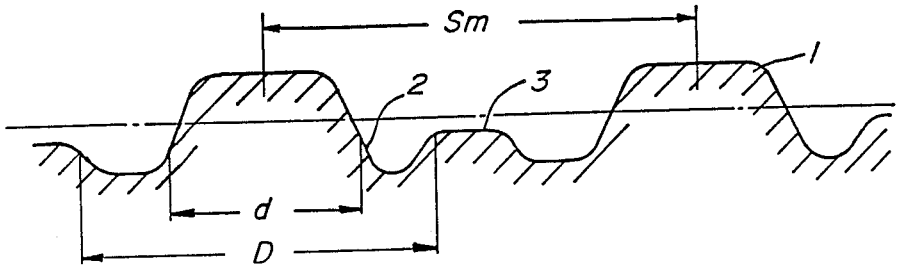
FIG. 9 is a diagrammatic view showing a microscopic form of the steel sheet surface according to the invention.
Figure 10:
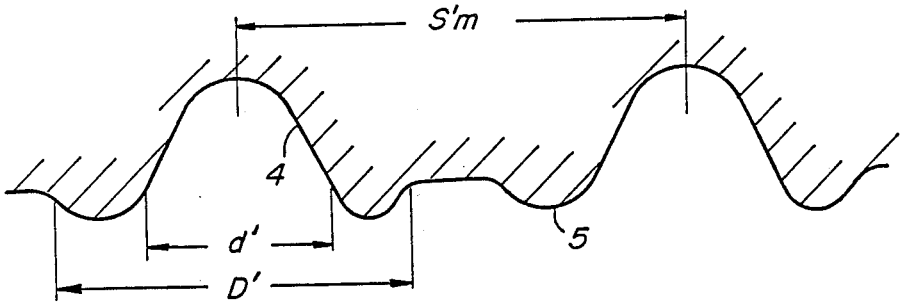
FIG. 10 is a diagrammatic view showing a microscopic surface form of the work roll used for temper rolling the steel sheet according to the invention.

FIG. 9 schematically shows a microscopic form on the surface of the steel sheet for painting according to the invention, while FIG. 10 schematically shows the surface pattern formed on the surface of the work roll for temper rolling through laser as a high density energy source.

In FIGS. 9 and 10, numeral 1 is a mountain portion, numeral 2 a valley portion, numeral 3 a middle flat portion, numeral 4 a concave portion, and numeral 5 an upheaved portion.

According to the invention, a work roll for temper rolling is dulled through a high density energy source, e.g. a laser as follows.

That is, a laser pulse is projected onto the surface of the rotating work roll in sequence to regularly fuse surface portions of the roll exposed to laser energy, whereby crater-like concave portions (hereinafter referred to as a crater simply) 4 are regularly on the surface of the work roll. In this case, the fused base metal of the work roll upheaves upward from the surface level of the roll in the form of ring around the crater 4 to form a flange-like upheaved portion 5. Moreover, the inner wall layer of the crater 4 inclusive of the upheaved portion 5 is a heat-affected zone to a base metal structure of the roll.

The depth and diameter of the crater 4 formed on the roll surface through laser pulse are determined by the intensity of energy in the incident laser and the projecting time, which give a quantity defining a roughness corresponding to surface roughness Ra in the work roll dulled through the conventional shot blast process.

The base metal of the roll heated by laser instantly changes into a metallic vapor due to large energy density of irradiated laser. In this case, the fused metal is blown away from the roll surface by the generated vapor pressure to form the crater 4, while the blown fused metal again adheres to the circumference of the crater 4 to form the upheaved portion 5 surrounding the crater 4. Such a series of actions are more efficiently performed by blowing an auxiliary gas such as oxygen gas or the like to the reaction point.

The above craters 4 are regularly formed by regularly irradiating the laser pulse while rotating or axially moving the work roll, whereby the surface of the roll is rendered into a rough state through the gathering of these formed craters. As seen from FIG. 10, a portion located between the adjacent craters 4 outside the upheaved portion 5 is a flat surface corresponding to the original roll surface. Moreover, the mutual distance between the adjacent craters can be adjusted by controlling the frequency of laser pulse in relation to the rotating speed of the roll in the rotating direction of the roll and by controlling the pitch of moving the irradiation position of the laser in the axial direction of the roll.

Although the invention has been described with respect to the use of laser as a high density energy source, similar results are obtained when using a plasma or an electron beam as a high density energy source.

A steel sheet such as a cold rolled steel sheet after annealing or the like is rolled at a light draft at the temper rolling step using the work roll dulled through laser as mentioned above, whereby the dull pattern formed on the surface of the work roll is transferred to the surface of the steel sheet to thereby give a rough surface to the steel sheet.

In the temper rolling, the draft is preferably at least 0.3%. When the draft is too small, the temper rolling operation itself is unstable and it is difficult to conduct the dulling of the steel sheet surface.

When microscopically observing the steel sheet surface at the temper rolling step, as shown in FIG. 9, the upheaved portions 5 having substantially a uniform height around the crater 4 on the surface of the roll are pushed to the surface of the steel sheet under a strong pressure, whereby the local plastic flow of material is caused near the surface of the steel sheet softer than the material of the roll and consequently metal of the steel sheet flows into the craters 4 of the roll to form the mountain portion 1. In this case, the top surface of the mountain portion 1 upheaved inside the crater 4 becomes held flat at the same level as the original steel sheet surface, while the middle flat portion 3 is also formed outside the upheaved portion 5 of the roll between the adjoining craters 4, 4.

In this way, the steel sheets having a microscopic section profile as hhown in FIG. 9 (LD sheets) are obtained by transferring the dull pattern of the work roll as shown in FIG. 10 to the steel sheet surface during the temper rolling.

Figure 11:
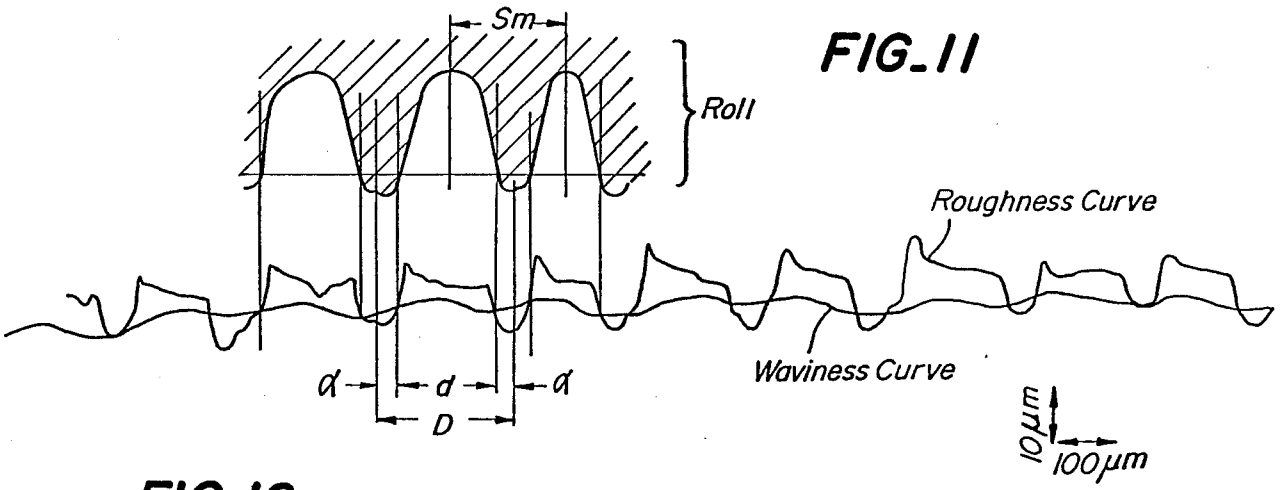
FIGS. 11 and 12 are schematic views showing the behavior of temper rolling according to the invention, respectively.

When the section profile of the thus obtained LD sheet is measured by a roughness measuring machine, as shown in FIG. 11, the wavelength of the waviness curve is well coincident with the wavelength of the roughness curve. This shows that the waviness component in the regular roughness pattern of the LD sheet is controlled by determining the microscopic section profile or dull pattern of the work roll.

Figure 12:
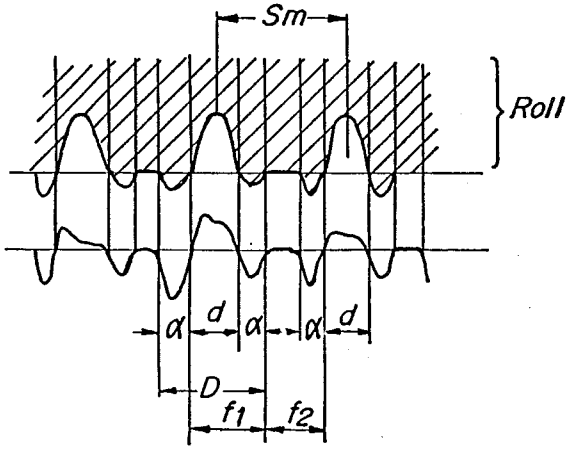

In such a section profile, there are two wavelengths $f_1$ *and* $f_2$ as shown in FIG. 12. As previously mentioned, it is necessary that the wavelength of waviness component in the waviness curve at the section profile of the steel sheet temper rolled with laser dulled work rolls be not more than 400 μm for improving the image definition (C, %) as a distinctness of image after painting, so that the above two wavelengths $f_1$ and $f_2$ should be not more than 400 μm. Now, the wavelengths $f_1$ and f2 are represented from FIG. 12 by d, D and Sm defined in FIG. 9 as follows:

$$f_1 = d + a = d + \frac{D-d}{2} = \frac{D+d}{2} \leqq 400\ \mu m$$

$$f_2 = Sm - \frac{d}{2} - \frac{d}{2} - a = Sm - \frac{D+d}{2}$$

$$= Sm - f_1 \leqq 400\ \mu m$$

$$\therefore\ Sm = f_1 + f_2 \leqq 800\ \mu m$$

Therefore, the surface of the steel sheet according to the invention is sufficient to satisfy $(D+d)/2 \leqq 400$ μm and $Sm \leqq 800$ μm for reducing the waviness component with a wavelength of more than 400 μm in the waviness curve as previously mentioned.

That is, according to the invention, the section profile of the steel sheet satisfying $(d+D)/2 \leqq 400$ μm and $Sm \leqq 800$ μm can reproducibly be formed with laser dulled work rolls of regular dull pattern, so that the distinctness of image after painting is always excellent. In this case, d and D can be controlled by determining an output of laser and a laser irradiating time per crater, while Sm can be controlled by determining a revolution number of work roll, a revolution number of chopper and a moving amount per unit time of laser spot in axial direction of work roll. These conditions can easily be set in the operation of laser machine.

EXAMPLE

Various steel sheets as shown in the following Table 2 were temper rolled with work rolls dulled by shot blast process, discharge working process or laser process to obtain section profiles having (d+D)/2, Sm and Wca as shown in Table 2.

Then, the distinctness of image was evaluated with respect to the above dulled steel sheets by means of an image measuring machine (HA-ICM model) made by Suga Shikenki K.K. showing an image definition (C, %) to obtain results as shown in FIG. 8.

TABLE 2

| Kind of steel sheet | Ra (μm) | Dulling process of work roll | Wca (μm) | $\frac{D+d}{2}$ (μm) | Sm (μm) |
|---|---|---|---|---|---|
| S8 | 1.43 | shot blast | 0.81 | — | — |
| S51 | 1.92 | ↑ | 1.04 | — | — |
| S52 | 2.01 | ↑ | 1.37 | — | — |
| L81 | 1.16 | laser | 0.78 | 175 | 265 |
| L51 | 2.22 | ↑ | 0.82 | 164 | 272 |
| L52 | 2.54 | ↑ | 1.30 | 139 | 260 |
| I | 1.58 | ↑ | 0.63 | 167 | 181 |
| J | 1.18 | ↑ | 0.52 | 166 | 201 |
| K | 1.82 | ↑ | 0.62 | 180 | 204 |
| B5 | 1.59 | ↑ | 1.04 | 103 | 301 |
| B8 | 0.91 | ↑ | 0.54 | 131 | 161 |
| L82 | 1.22 | ↑ | 0.82 | 150 | 230 |
| L53 | 2.60 | ↑ | 1.30 | 230 | 430 |
| E1 | 1.25 | discharge working | 0.72 | — | — |
| E2 | 1.13 | ↑ | 0.90 | — | — |
| E3 | 1.21 | ↑ | 0.92 | — | — |
| E4 | 1.48 | ↑ | 1.21 | — | — |

Among the data of Table 2 and FIG. 8, the data of S8 sheet and E1 sheet are very exceptional cases as mentioned below. That is, in the conventional shot blast process, the work roll is dulled by thrusting grids from a hopper through a rotating blade onto the work roll to form fine unevenness on the surface of the work roll through impact energy. However, such a roughening of the work roll surface is based on random phenomenon due to the thrusting of grids onto the roll surface, so that the control of center-line average roughness Ra in the roughness curve is possible but the control of wavelength and amplitude (or intensity) in the waviness curve is essentially impossible. On the other hand, in the conventional discharge working process, the discharge is first caused at a position of minimum distance between electrode and work roll to perform local melt working of the roll surface through discharge energy, so that the sizes and positions of convex and concave portions in the roughened surface are random and consequently the control of wavelength and amplitude in the waviness curve is impossible.

Further, each of the laser dulled sheets and shot blast dulled sheet (S51 sheet) was subjected to a painting under conditions as shown in the following Table 3 to form a three-layer coat on the surface of the steel sheet.

TABLE 3

| Painting conditions | Phosphating treatment | Electrode-position | Inter coating | Top coating |
|---|---|---|---|---|
| Kind of paint | Bonderite 3007[1] (Japan Perkerizing K. K.) | Elecron 8450-N[2] (Kansai Paint K. K.) | Lugabake KPX-27[3] (Kansai Paint K. K.) | Lugabake 6200[4] (Kansai Paint K. K.) |
| Painting process | dipping | cation ED | minibell painting | minibell painting |

TABLE 3-continued

| Painting conditions | Phosphating treatment | Electrode-position | Inter coating | Top coating |
|---|---|---|---|---|
| | | thickness t = 20 μm | thickness t = 35 μm | d thickness t = 35 μm |

Figure 13A:
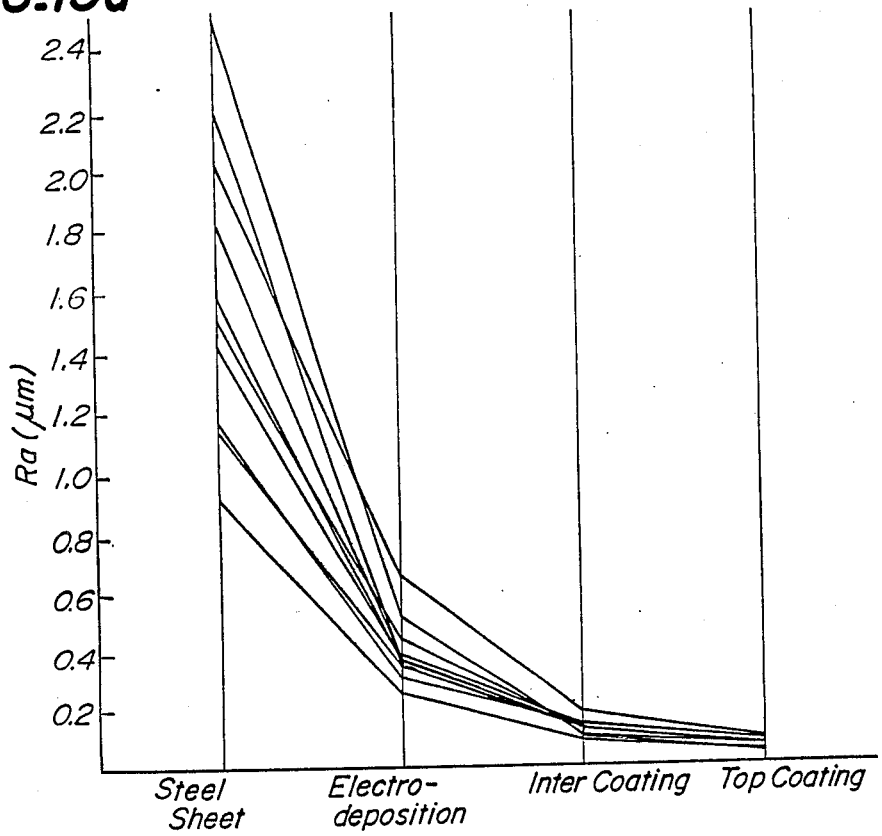
FIG. 13 is a graph showing changes of Ra and Wcm every painting step, respectively.
Figure 13B:
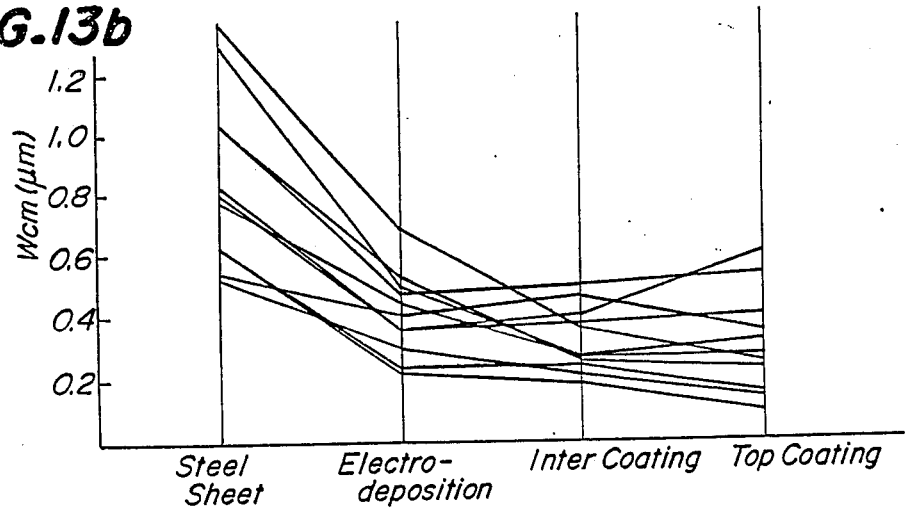

Note:
Sanding was not conducted at each step, and the painting was conducted by horizontal and vertical systems.
[1]trade name, fine particle type phosphating agent for dipping
[2]trade name, cation type epoxy resin paint
[3]trade name, polyester melamine resin paint
[4]trade name, polyester melamine resin paint As shown in FIG. 13*a*, the value of center-line average roughness Ra in each of the laser dulled steel sheets lowers together with the progress of the painting process and is converged to a range of 0.04–0.08 μm irrespectively of the value of Ra in the starting steel sheet after the top coating. On the other hand, the filtered maximum waviness (Wcm) after the top coating are largely scattered within a range of 0.1 to 0.6 μm in accordance with the surface state of the starting steel sheet as shown in FIG. 13*b*. As seen from FIGS. 13*a* and 13*b*, the distinctness of image after painting is largely influenced by Wcm of the steel sheet.

Figure 14:
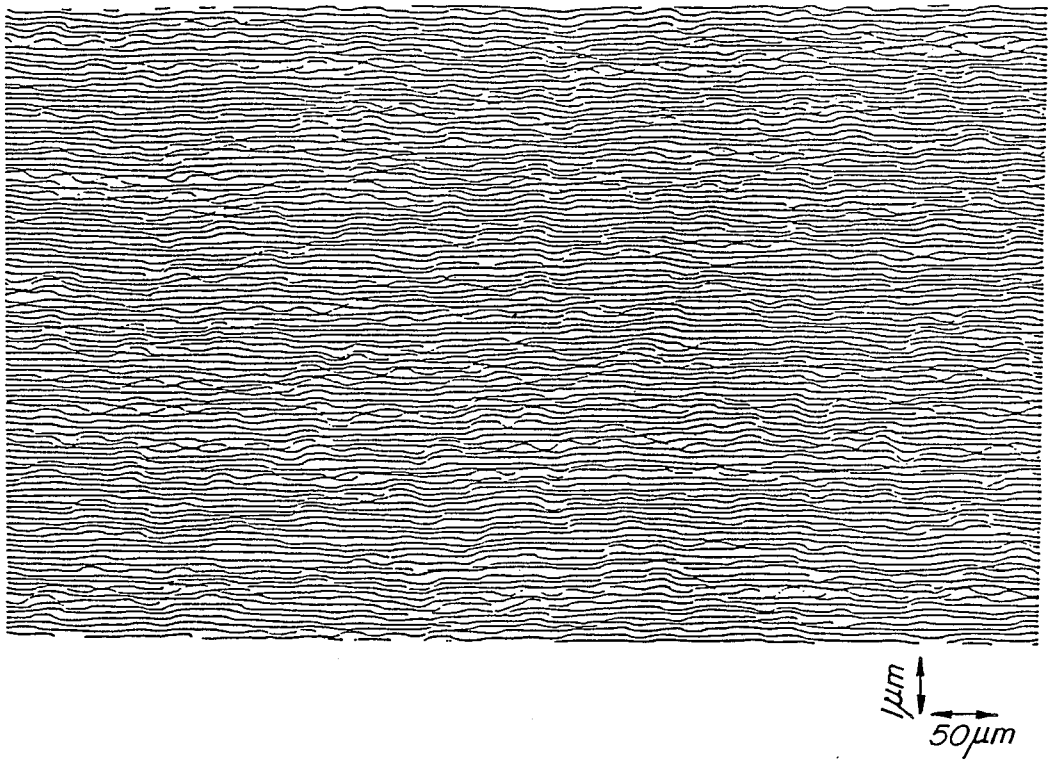
FIG. 14 is a chart showing a three-dimensional roughness curve after painting the steel sheet dulled through laser according to the invention.
Figure 15:
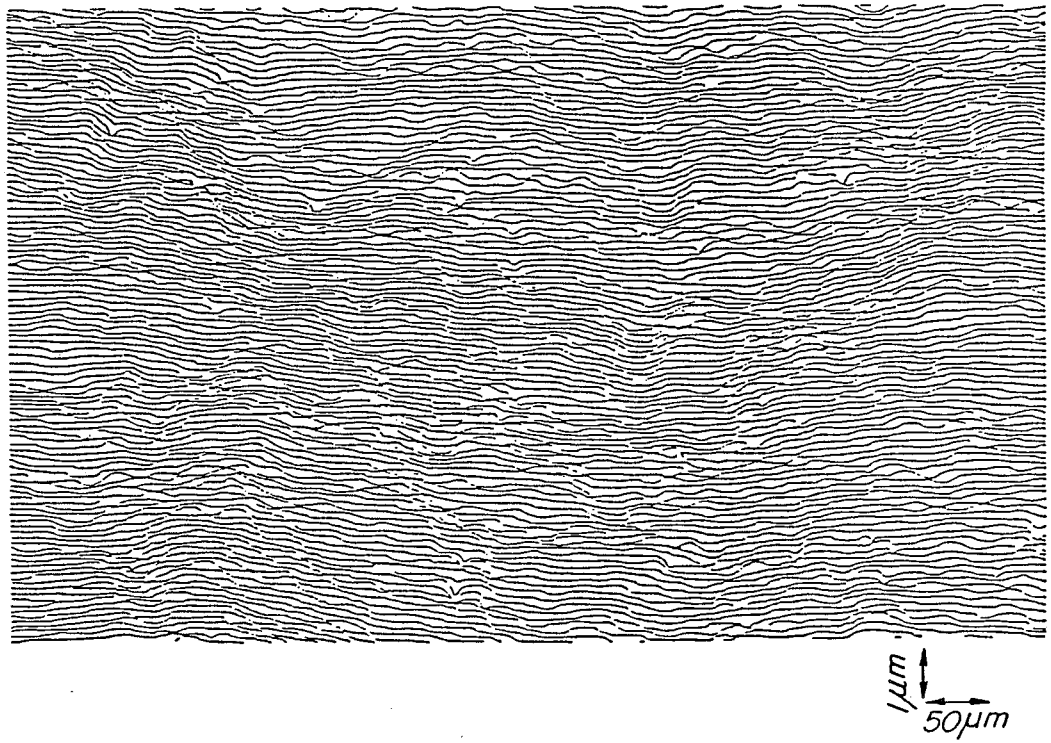
FIG. 15 PRIOR ART
FIG. 15 is a chart showing a three-dimensional roughness curve after painting the steel sheet dulled through the conventional shot blast process.

Then, the surfaces of K sheet (laser dulled steel sheet according to the invention) and S51 sheet (conventional shot blast dulled steel sheet) were measured by means of a three-dimensional roughness meter to obtain results as shown in FIGS. 14 and 15.

When the coated K sheet of FIG. 14 is compared with the coated S51 sheet of FIG. 15, since the value of Wca is 0.62 μm in the K sheet and 1.04 μm in the S51 sheet (citron-like skin) though the value of Ra is substantially equal, there is caused a great difference in the painted surface between the K sheet and the S51 sheet.

According to the invention, steel sheets having an improved distinctness of image after painting can stably be produced by controlling the waviness curve at the section profile of the steel sheet without damaging the press formability.

What is claimed is:

1. A steel sheet for painting, characterized in that the surface of the steel sheet has a microscopic form comprised of mountain portions, groove-like valley portions formed so as to surround a whole or a part of the mountain portion, and middle flat portions formed between the mountain portions outside of the valley portion so as to be higher than the bottom of the valley portion and lower than or equal to the top surface of the mountain portion, and satisfies the following relations:

$$(d+D)/2 \leqq 400\ \mu m$$

$$Sm \leqq 800\ \mu m$$

wherein d is a mean diameter in an inner peripheral edge of the valley portion, D is a mean diameter in an outer peripheral edge of the valley portion and Sm is a mean center distance between the adjoining mountain portions.

2. A method of producing steel sheets for painting, which comprises subjecting a surface of a work roll for temper rolling to a dulling of surface pattern comprised of a combination of fine crater-like concave portions and ring-like convex portions upheaving at the outer peripheral edge of the concave portion and satisfying the following relations:

$$(D'+d')/2 \leqq 400\ \mu m$$

$$S'm \leqq 800\ \mu m$$

wherein d' is a diameter in an inner peripheral edge of the ring-like convex portion, D' is a diameter in an outer peripheral edge of the ring-like convex portion and S'm is a mean center distance between the adjoining concave portions, through a high density energy source, and then temper rolling a steel sheet with a pair of work rolls, at least one of which being the above dulled work roll to transfer the surface pattern of the dulled work roll to the surface of the steel sheet.

3. The method according to claim 2, wherein said high density energy source is a laser.

4. The method according to claim 2, wherein said high density energy source is an electron beam.

5. The method according to claim 2, wherein said temper rolling is carried out at a draft of at least 0.3%.

* * * * *